United States Patent [19]

King

[11] 4,256,433

[45] Mar. 17, 1981

[54] HYDRAULIC CIRCUIT FOR EARTHWORKING IMPLEMENT

[75] Inventor: Donald R. King, Burlington, Iowa

[73] Assignee: J. I. Case Company, Racine, Wis.

[21] Appl. No.: 28,352

[22] Filed: Apr. 9, 1979

[51] Int. Cl.[3] ..... B66C 23/66

[52] U.S. Cl. ..... 414/694; 91/401; 212/189

[58] Field of Search ..... 91/401; 414/694, 695, 414/697; 280/764; 212/145; 248/188.8, 188.9; 182/108, 111

[56] References Cited

U.S. PATENT DOCUMENTS

| | | | |
|---|---|---|---|
| 3,376,984 | 4/1968 | Long et al. | 414/694 |
| 3,450,006 | 6/1969 | White | 91/401 |
| 3,515,224 | 6/1970 | Seaberg | 91/401 X |
| 3,951,281 | 4/1976 | Parquet | 414/695 X |
| 3,955,695 | 5/1976 | Maurer | 414/697 |
| 4,026,428 | 5/1977 | Shumaker | 414/694 |
| 4,074,821 | 2/1978 | Long | 414/694 |
| 4,132,324 | 1/1979 | Long | 280/764 X |
| 4,138,928 | 2/1979 | Pilch | 414/694 X |

*Primary Examiner*—Robert G. Sheridan
*Assistant Examiner*—Terrance L. Siemens
*Attorney, Agent, or Firm*—Dressler, Goldsmith, Shore, Sutker & Milnamow, Ltd.

[57] ABSTRACT

A hydraulic circuit for supplying fluid to a ram to move an elongated member about a fixed axis on a frame includes a reservoir, pump, valve and conduits connected to opposite ends of the fluid ram. The fluid ram includes a cylinder pivoted on a ram pivot on the frame adjacent to and outside the fixed axis and the elongated axis of the member is moved across the ram pivot as the member is moved between working and transport positions. The hydraulic circuit incorporates a valve element carried by the piston and moved from a seated position at the critical time when the elongated axis is generally coincident with the ram axis to interconnect the two cylinder chambers and assist in moving the axis across the ram axis.

13 Claims, 3 Drawing Figures

36
38
30
32
10
16
24
28
18
34
26
22
20
40
14
12
14

R
C 130
132
68
52
48
134
122
120
66
70
74
50
54
60
72
62
64
56
20
44
74
42
S
46

54
76
80
84
94
82
92
88
74
78

90
122
96
80
50
86
112
68
44
104
106
102
100
108
110

HYDRAULIC CIRCUIT FOR EARTHWORKING IMPLEMENT

TECHNICAL FIELD

The present invention relates generally to earthworking implements of the type having stabilizer arms pivoted on the frame of the implement and more particularly to a hydraulic circuit for pivoting the stabilizer arms between working and transport positions.

While not limited to any particular type of earthworking implement, the present invention is particularly useful for a backhoe unit having stabilizer arms of the type disclosed in U.S. Pat. Nos. 3,376,984 and 4,132,324, which are assigned to the assignee of the present invention and are incorporated herein by reference.

Many types of earthworking implements, such as boom cranes, backhoes, front end loaders and other units commonly have one or more stabilizer arms associated therewith for stabilizing the vehicle while the implement is being manipulated. The stabilizer arms, sometimes referred to as outriggers, are typically positioned on the frame which supports the implement and are pivoted between a first ground engaging and stabilizing position and a second upright storage or transport position during which the vehicle is moved from one job site to another.

One of the difficulties encountered in designing stabilizer arms is to have the arms long enough to provide adequate stability for the implement frame when in the first position and to be capable of being retracted to a transport position wherein the transverse dimension of the overall implement has a minimum width.

BACKGROUND PRIOR ART

Various types of stabilizer arms assemblies have been proposed and typical examples of such devices are disclosed in U.S. Pat. Nos. 3,951,281; 3,955,695 and 4,026,428.

In each of these patents, a stabilizer arm has one end pivotally supported on the implement frame and is pivoted between stabilizing and transport positions through a fluid ram. In all of these stabilizer mechanisms, the stabilizer arm or outrigger is essentially suspended in the transport position and is held in such position by the fluid ram associated therewith. In the transport position, the stabilizer arm essentially extends upwardly and slightly outwardly of the pivot axis for the inner end of the arm which in essence increases the overall width of the vehicle frame.

Quite recently it has been proposed to have the stabilizer arm move "overcenter" with respect to the pivot axis for the fluid ram so that the stabilizer arm is essentially located between the pivot axis for the fluid ram and the frame, which decreases the overall width of the frame and the stabilizer arms. Such an arrangement is disclosed in U.S. Pat. No. 4,132,324, which is incorporated herein by reference.

However, one of the problems that has been encountered with a construction of this type is the proper manipulation of the fluid ram to move the longitudinal axis of the stabilizer arm across the pivot point for the fluid ram. This arrangement requires accurate timing and manipulation of the control valve which is utilized to control the supply of hydraulic fluid to opposite ends of the fluid ram. To raise the stabilizer arm or outrigger from its working position to its transport position, pressurized fluid must be provided to the rod end of the cylinder until such time as the longitudinal axis for the stabilizer arm is coincident with the pivot axis for the fluid ram on the frame. At this time, it is necessary for the operator to quickly reverse the valve so that pressurized fluid is delivered to the opposite end of the fluid ram to move the stabilizer arm to its final transport position. This problem is accentuated by the fact that when the stabilizer arm axis is coincident with the pivot point for the fluid ram, the stabilizer arm is still extending upwardly and away from the frame and thus, the weight thereof will have a tendency to move the stabilizer arm downwardly towards the working position.

SUMMARY OF THE INVENTION

According to the present invention, a hydraulic circuit has been developed which is capable of automatically reducing the pressure of the pressurized end of the fluid ram as the stabilizer arm moves across the pivot axis on the frame for the fluid ram.

More specifically, the specific implement to which the present invention is directed consists of an elongated member pivoted on a fixed frame about a pivotal connection on the frame between a working position and a transport position through a fluid ram that has one end pivotally connected by a ram pivot to the fixed frame and the opposite end connected to the elongated member adjacent the outer end thereof. The elongated axis for the elongated member is located outwardly of the fluid ram pivot in the working position and inwardly of the fluid ram pivot in the transport position. The hydraulic circuit includes a fluid reservoir, pump means for supplying pressurized fluid from the reservoir and conduit means connecting the reservoir and pump means to opposite ends of the fluid ram with valve means for alternating the connection between opposite ends of the fluid ram and the reservoir and pump means, respectively. The hydraulic circuit also includes connection means for connecting both ends of the fluid ram to the reservoir when the elongated axis for the member is generally coincident with the pivotal connection on the frame for the fluid ram.

In the specific embodiment illustrated, the fluid ram is in the form of a cylinder and piston rod assembly and the connection means is incorporated into the piston and the piston rod assembly. The connection means consists of a valve element that is slidably supported in a valve bore formed in the piston and the valve element has enlarged portions at opposite ends which cooperate with valve seats defined on opposite surfaces of the piston. The enlarged portion of the valve element is normally biased against the seat on the pressurized side of the piston and the cylinder has an adjustable pin or moving means carried thereon which will engage the valve element and move the valve element with respect to the piston to thereby interconnect the respective chambers in the cylinder located on opposite sides of the piston.

In a slightly modified form of the invention, a back pressure is also created on the unpressurized side of the piston to assist in producing a small extension of the piston rod as the axis of the elongated member passes over the pivotal connection for the fluid ram to assist in moving the elongated member to the transport position.

DETAILED DESCRIPTION

Figure 1:
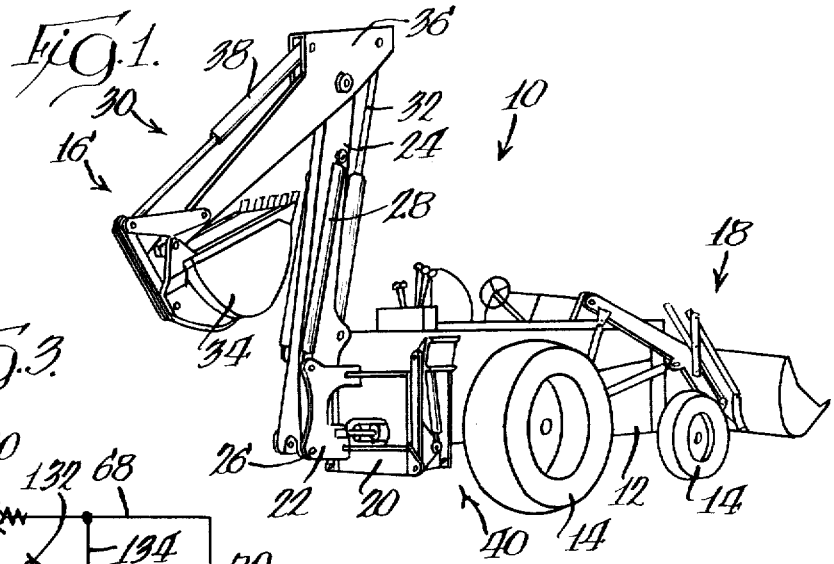
FIG. 1 is a perspective view of an earthworking implement having the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawings illustrated an earthworking implement, generally designated by reference numeral 10, of the type commonly referred to as a "loader/-backhoe" or simply a "backhoe". Earthworking implement 10 includes a chassis 12 supported by a plurality of wheels 14 and having a backhoe unit or first material handling implement 16 supported on one end thereof and a second material handling implement or loader 18 supported at the opposite end thereof. Since the loader unit 18 forms no part of the present invention, a detailed description thereof does not appear to be necessary.

Backhoe unit 16 consists of a fixed frame 20 which is supported on chassis 12, through suitable means (not shown), and has a conventional swing tower 22 pivotally supported about a vertical pivot axis defined by pins (not shown). Swing tower 22 has an elongated member or boom 24 pivotally supported at one end by pins defining a horizontal pivot axis 26. Boom 24 is moved between working and transport positions through fluid rams 28 and the transport position is preferably an overcenter position as is more clearly disclosed and described in U.S. Pat. No. 3,376,984, incorporated herein by reference.

Material handling unit 16 also includes a dipper assembly 30 pivotally supported on the outer end of boom 24 and movable between positions through a further fluid ram 32. A bucket 34 is pivotally supported on the outer end of an elongated member 36 and is pivoted between positions through a bucket fluid ram 38.

As is customary in backhoe units of this type, it is standard practice to incorporate some type of stabilizing device between either chassis 12 or fixed frame 20 to provide lateral stabilization and support of the vehicle during operation of the backhoe unit 16. In the illustrated embodiment of the invention, this lateral stabilization and support is provided by a pair of outrigger assemblies generally designated by reference numeral 40 (only one being shown with the understanding that an identical assembly would be located on the opposite side of frame 20).

Each stabilizer assembly 40 consists of an elongated stabilizer arm 42 that has one end pivotally connected to fixed frame 20 through a pivot pin 44. Stabilizer arm 42 has a stabilizer foot 46 pivotally supported on the outer end thereof and arm 42 is pivoted about pivot pin 44 through a fluid ram 48. In the illustrated embodiment, fluid ram 48 includes a cylinder 50 pivoted by a pivot pin 52 on fixed frame 20 with a piston rod 54 pivotally connected to the outer end of stabilizer arm 42 through a pivot pin 56.

As disclosed in detail in U.S. Pat. No. 4,132,324, stabilizer arm 42 has an elongated axis S that passes through pivot pins 44 and 56 while the fluid ram 48 has a ram axis R which extends through pivot pins 52 and 56. In the prior art patent, the various elements are arranged such that stabilizer axis S is located outside of pivot pin 52 in the working position and is located inside the pivot pin and ram axis R when the stabilizer arm is respectively in the working position and transport position. These two positions are respectively illustrated by the solid and dotted lines in FIG. 3.

According to the present invention, the hydraulic circuit, generally designated by reference numeral 60, incorporates a mechanism for assisting in moving the stabilizer arm axis S across the pivot point 52 for fluid ram 48 as the stabilizer arm is being moved from the working position to the transport position.

Figure 3:
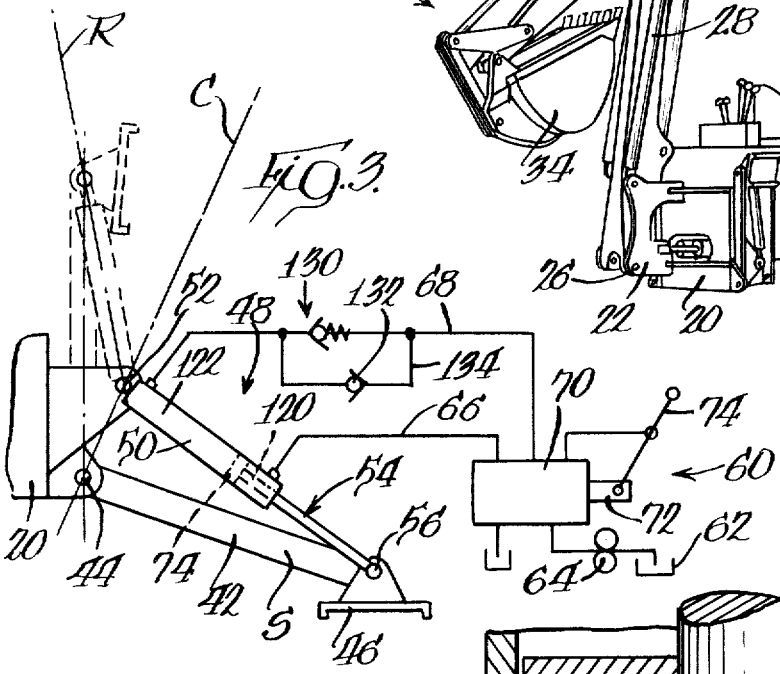
FIG. 3 is a schematic illustration of the hydraulic circuit having the present invention incorporated therein.

As more clearly illustrated in FIG. 3, hydraulic circuit 60 includes a fluid reservoir 62, a pressurized fluid source or pump 64, and first and second conduits 66 and 68 respectively leading from reservoir 62 and pump 64 to opposite ends of cylinder 50. A three position valve 70 is located in conduits 66 and 68 and has a valve spool 72 movable between positions so as to alternately connect the reservoir and pump to opposite ends of cylinder 50.

According to the present invention, the hydraulic circuit incorporates a mechanismm for relieving the pressurized end of cylinder 50 when the axis S for stabilizer arm 42 is coincident with pivot axis or ram fluid axis 52 as the stabilizer arm is being moved between positions.

This is accomplished by connection means for connecting both ends or chambers of cylinder 50 located on opposite sides of piston 74 to the reservoir at the critical time when the elongated axis for the stabilizer arm is coincident with the pivot axis for the fluid ram.

Figure 2:
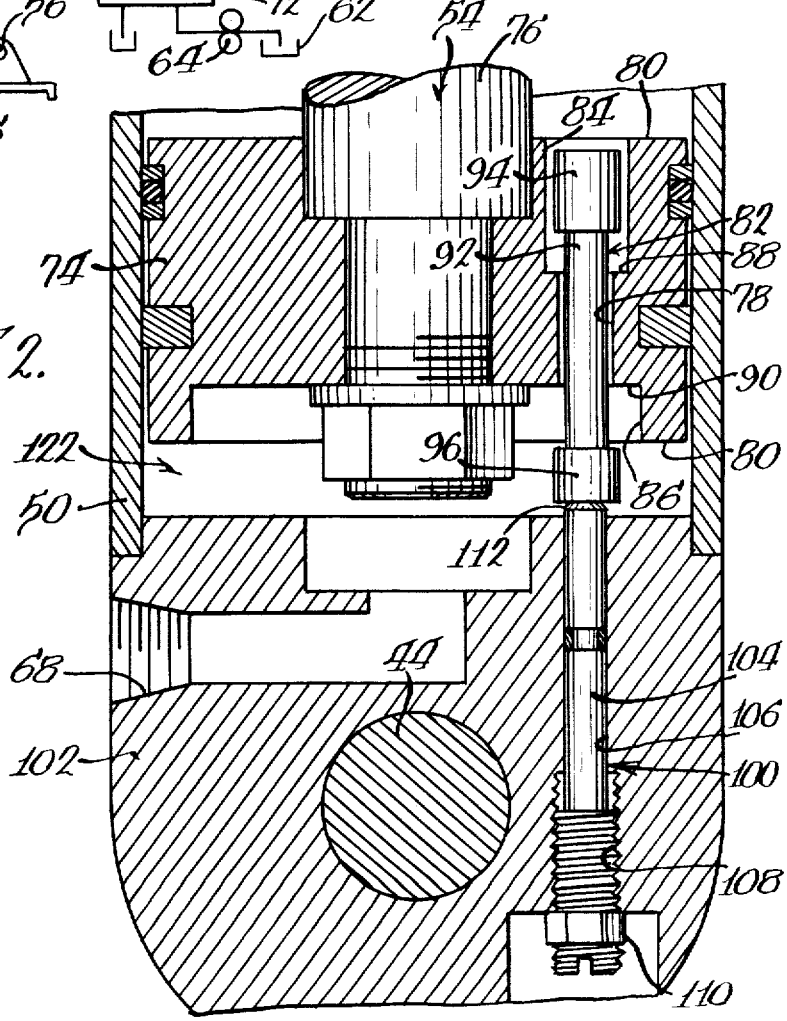
FIG. 2 is an enlarged fragmentary sectional view of an end portion of a fluid ram forming part of the implement illustrated in FIG. 1.

As most clearly illustrated in FIG. 2, piston rod 54 includes a piston 74 having a rod 76 connected thereto and extending from the rod end of cylinder 50. Piston 74 has an elongated bore 78 extending between opposed surfaces 80 and a valve element 82 is slidably supported within bore 78.

Valve bore 78 also has enlarged portions 84 and 86 extending from opposite surfaces 80 of piston 74 to define first and second valve seats 88 and 90. Valve element 82 consists of an intermediate stem 92 with first and second enlarged portions or valve heads 94 and 96 respectively located on opposite ends thereof and defining valve surfaces which are adapted to respectively engage valve seats 88 and 90.

Cylinder 50 also incorporates valve opening means 100 in the head end 102 thereof for moving valve element 82 between positions, as will be described later. Opening means or moving means 100 consists of a pin 104 extending through an opening 106 with opening 106 having at least a partially threaded portion 108 and pin 104 having a cooperating threaded portion. A lock nut 110 is received on the threaded outer end of pin 104 to hold the adjustable opening means in an adjusted position. The inner end 112 of pin 104 is aligned with the enlarged portion 96 of valve element 82.

With the structure so far described, in order to move stabilizer arm 42 from the solid-line working position to the dotted-line transport position illustrated in FIG. 3, it is necessary to pressurize the rod end of cylindeer 50 by moving valve spool 72 to a position where pump 64 is connected to conduit 66 while conduit 68 is connected to reservoir 60. In this position, chamber 120 located on one side of piston 74 is pressurized while the second chamber 122 on the opposite side of piston 74 is connected to reservoir 60 through conduit 68. With the rod end chamber 120 pressurized, the pressurized fluid will act on the exposed surface of the enlarged portion 94 and securely seat the valve element against valve seat 88 and prevent flow of hydraulic fluid through bore 78. Thus, piston rod 54 is being retracted with respct to cylinder 50 and stabilizer arm 42 is pivoted counterclockwise, as viewed in FIG. 3.

At the point in time when stabilizer arm axis S is coincident with pivot pin 52, fluid ram axis R is also coincident therewith, being indicated by the dotted-line C in FIG. 3, at which time piston 74 will be in a fully retracted position.

According to the present invention, pin 104 is adjusted so that the free end thereof engages enlarged end 96 of valve element 82 just prior to when the two axes for the fluid ram and stabilizer arm are coincident with each other. This will cause the valve element 82 to move from its seated position to the position illustrated in FIG. 2 wherein chambers 120 and 122 are interconnected so that both chambers are connected to the reservoir 60.

By proper selection and adjustment of pin 104 with respect to the free surface of enlarged portion 96 of valve element 82, this opening of bore 78 to have chambers 120 and 122 interconnected is designed such that the opening will occur at an appropriate time so that the momentum and mass of the stabilizer arm 42 and fluid ram 48 will carry the stabilizer axis S inwardly of the pivotal connection 52 and the stabilizer arm can ultimately be moved to the final transport position illustrated in FIG. 3.

Immediately after the stabilizer axis S moves across pivot pin 52, valve spool 72 can be reversed so that pressurized fluid is supplied into the rod end chamber 122 to extend piston rod 54 and essentially lock the stabilizer arm in the transport position.

Movement of the stabilizer arm from the transport to the working position is accomplished by reversing the procedure set forth above.

If desired, extension of fluid ram 50 while the stabilizer arm is moved to its transport position can be assisted by creating a slight back pressure in the head end chamber 122. This can be accomplished by providing spring biased valve means 130 as a one-way check valve in line 68 which prevents flow from valve 70 to chamber 122 and a second check valve 132 in a parallel line 134 providing unidirectional unrestricted flow from valve 70 to chamber 122. With this arrangement, the spring bias of check valve 130 can be adjusted to create a desired back pressure in chamber 122.

Thus, when valve element 82 is open, a pressure will be maintained in chamber 122 and exceed the pressure in chamber 120 to move valve element 82 to a second position. In this position, enlarged portion 96 is seated on surface 90 and the back pressure will assist in extending piston rod 54 to assist in moving the stabilizer arm to the transport position without changing the valve position. Once the pressure in chambers 120 and 122 is equalized, valve spool 72 can be moved to pressurize chamber 122 and move the outrigger and fluid ram to its final locked transport position, illustrated in dotted lines in FIG. 3.

It will thus be appreciated, that the hydraulic circuit is unique in that with only minor modification of one component of the fluid ram 48, the hydraulic circuit is modified to provide a power assist in moving the stabilizer arm to its full transport position. It should be noted that by having pin 104 adjustable with respect to cylinder head 102, the position at which valve element 82 opens can readily be changed within a short period of time by loosening lock nut 110 and rotating pin 104 in the appropriate direction.

While the specific invention has been disclosed and described in connection with moving stabilizer arm 42 between working and transport positions, the invention could also be incorporated into the hydraulic circuit for moving the boom or elongated member 24 from its working to its transport position, as is more fully disclosed and described in U.S. Pat. No. 3,376,984. It should also be noted that while the boom disclosed in this patent utilizes two fluid rams and a solid boom construction, the boom could also be of the twin boom concept with a single fluid ram, as disclosed in U.S. Pat. No. 4,074,821, assigned to the assignee of the present invention.

It should also be pointed out that in the preferred embodiment of the invention, stabilizer arm 42 is preferably of the type disclosed in U.S. Pat. No. 4,132,324 wherein two stabilizer arm members are located on opposite sides of a single fluid ram. However, again, a single stabilizer arm and a pair of fluid rams or a single fluid ram could be utilized in conjunction with the hydraulic circuit of the present invention.

What is claimed is:

1. In an earthworking implement having a fixed frame and an elongated member pivoted on said frame by a fluid ram having a first pivotal connection on said frame and a second pivotal connection on said elongated member, said elongated member having a transport position defined between said frame and said first pivotal connection and a working position extending away from said frame, and a hydraulic circuit for supplying fluid to said rams, said hydraulic circuit including a reservoir, pump means for supplying pressurized fluid from said reservoir, conduit means connecting said reservoir and pump means to opposite ends of said fluid ram with valve means in said conduit means, and connection means for connecting both ends of said fluid ram to said reservoir when an elongated axis of said elongated member is coincident with said first pivotal connection as said member is being moved from said working position to said transport position.

2. An earthworking implement as defined in claim 1, in which the fluid ram includes a cylinder and piston rod assembly and in which the connection means is carried by said piston rod assembly.

3. An earthworking implement as defined in claim 2, in which the connection means includes a valve element with said piston rod having a bore slidably supporting said valve element.

4. An earthworking implement as defined in claim 3, in which said cylinder has a head end and a rod end and said rod end receives pressurized fluid when said elongated member is being moved to said transport position and in which said valve element is held in a closed, first position by the pressurized fluid, further including means for moving said valve element from said first position when said elongated axis is generally coincident with said first pivotal connection.

5. An earthworking implement as defined in claim 4, further including means between said head end and said reservoir for maintaining a predetermined pressure for the fluid flowing from said cylinder to said reservoir.

6. An earthworking implement as defined in claim 5, in which said bore has first and second valve seats at opposite ends thereof and in which said valve elements have first and second valve heads at opposite ends respectively cooperating with said valve seats and in which said predetermined pressure moves said second valve head into engagement with said second valve seat to cause said piston rod to extend.

7. An earthworking implement as defined in claim 1, in which said elongated member is a stabilizer arm pivoted on said frame.

8. An earthworking implement as defined in claim 1, in which said frame includes a swing tower and said elongated member is a boom pivoted on said swing tower.

9. A hydraulic circuit for supplying pressurized fluid from a source to opposite ends of a fluid ram interposed between a fixed frame and an elongated member pivotably connected to said frame about a fixed pivot point and an opposite end supported by said fluid ram, said fluid ram having a first pivotal connection on said frame and a second pivotal connection on said elongated member adjacent said opposite end with a fluid ram axis defined by an axis extending through said connections, said elongated member having an elongated axis extending through said fixed pivot point, said elongated member being pivotable from a transport position wherein said elongated axis is located inwardly of said fluid ram axis to a working position where said elongated axis is located outwardly of said fluid ram axis, said hydraulic circuit including a fluid reservoir, pump means for supplying pressurized fluid from said reservoir and conduit means connecting said reservoir and pump means to said fluid ram with valve means for alternating the connection to opposite ends of said fluid ram, and connection means for connecting both ends of said fluid ram to said reservoir when said elongated member is moved toward said transport position and said elongated axis and said fluid ram axis are generally coincident with each other.

10. A hydraulic circuit as defined in claim 9, in which said fluid ram includes a cylinder having a head end and a rod end, further including means for maintaining a predetermined pressure level for the fluid in said head end when said rod end is pressurized.

11. A hydraulic circuit as defined in claim 8, in which said fluid ram includes a piston and rod slidable in a cylinder with said rod extending through a rod end of said cylinder and in which said piston has a bore with a valve element slidable in said bore and cooperating therewith to define said connection means.

12. A hydraulic circuit as defined in claim 11, further including adjustable means in a head end of said cylinder for moving said valve element and provide said connection means through said bore when said axes are generally coincident.

13. A hydraulic circuit as defined in claim 12, in which adjustable means includes a threaded pin with said head end having a threaded bore aligned with said valve element and receiving said pin.

* * * * *